US010206553B2

(12) United States Patent
Ross et al.

(10) Patent No.: US 10,206,553 B2
(45) Date of Patent: Feb. 19, 2019

(54) HYDRAULICALLY ACTUATED DIVERTER FOR AN APPLIANCE

(71) Applicant: Haier US Appliance Solutions, Inc., Wilmington, DE (US)

(72) Inventors: Christopher Brandon Ross, Louisville, KY (US); Kyle Durham, Louisville, KY (US); Daniel J. Hart, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 15/276,837

(22) Filed: Sep. 27, 2016

(65) Prior Publication Data

US 2018/0084967 A1 Mar. 29, 2018

(51) Int. Cl.

| | |
|---|---|
| ***A47L 15/42*** | (2006.01) |
| ***A47L 15/50*** | (2006.01) |
| ***A47L 15/23*** | (2006.01) |

(52) U.S. Cl.

CPC ..... *A47L 15/4221* (2013.01); *A47L 15/23* (2013.01); *A47L 15/4225* (2013.01); *A47L 15/4259* (2013.01); *A47L 15/4261* (2013.01); *A47L 15/4293* (2013.01); *A47L 15/502* (2013.01); *A47L 15/507* (2013.01)

(58) Field of Classification Search

None

See application file for complete search history.

(56) References Cited

U.S. PATENT DOCUMENTS

| | | | | |
|---|---|---|---|---|
| 9,027,578 | B2 | 5/2015 | Boyer et al. | |
| 9,307,886 | B2 | 4/2016 | Durham et al. | |
| 2010/0043825 | A1* | 2/2010 | Bertsch | A47L 15/23 134/18 |
| 2012/0318389 | A1 | 12/2012 | Holstein et al. | |
| 2015/0101644 | A1 | 4/2015 | Durham et al. | |

FOREIGN PATENT DOCUMENTS

| | | | |
|---|---|---|---|
| JP | 4434616 | B2 | 3/2010 |
| JP | 4654767 | B2 | 3/2011 |
| JP | 04924722 | B2 | 4/2014 |

* cited by examiner

*Primary Examiner* — Jason Y Ko
*Assistant Examiner* — Cristi J Tate-Sims
(74) *Attorney, Agent, or Firm* — Dority & Manning, P.A.

(57) ABSTRACT

A hydraulically actuated diverter for selectively controlling a flow of wash fluid in a dishwashing appliance is provided. The hydraulically actuated diverter includes a top portion and a bottom portion that are coupled together to form a diverter chamber. A shaft of a diverter valve is slidably received within a channel defined by the bottom portion of the diverter. The shaft and the channel define an annular gap that allows the shaft to slide and rotate within the diverter chamber. The shaft defines an alignment member positioned within the annular gap to prevent the shaft from moving out of alignment with the channel, reducing the likelihood of excessive friction and binding of the diverter valve.

20 Claims, 8 Drawing Sheets

HYDRAULICALLY ACTUATED DIVERTER FOR AN APPLIANCE

FIELD OF THE INVENTION

The subject matter of the present disclosure relates generally to a diverter for an appliance, and more specifically to a hydraulically actuated diverter for a dishwashing appliance.

BACKGROUND OF THE INVENTION

Dishwashing appliances generally include a tub that defines a wash compartment. Rack assemblies can be mounted within the wash compartment of the tub for receipt of articles for washing. Spray assemblies within the wash compartment can apply or direct wash fluid towards articles disposed within the rack assemblies in order to clean such articles. Multiple spray assemblies can be provided including e.g., a lower spray arm assembly mounted to the tub at a bottom of the wash compartment, a mid-level spray arm assembly mounted to one of the rack assemblies, and/or an upper spray assembly mounted to the tub at a top of the wash compartment. Other configurations may be used as well.

A dishwashing appliance is typically equipped with at least one pump for circulating fluid through the spray assemblies. Certain conventional dishwashing appliances use a device, referred to as a diverter, to control the flow of fluid in the dishwashing appliance. For example, the diverter can be used to selectively control the flow of fluid through different spray assemblies or other fluid elements. In one construction, the diverter uses a hydraulically actuated diverter valve to selectively provide the flow of fluid to the spray assemblies without the need for a motor. In this regard, a housing of the diverter may define one or more outlet ports and the diverter valve may define one or more apertures. The diverter valve may be configured to move along an axial direction and rotate to selectively align the one or more aperture with the one or more outlet ports.

Notably, however, because the diverter valve must move along and rotate about an axial direction A within the diverter chamber, contact between components and the resulting friction and or binding can restrict the motion of the diverter valve in certain circumstances. For example, if the diverter valve tilts or fails to maintain axial alignment as it moves into the raised position, e.g., due to the imbalanced force of the flowing wash fluid, the diverter valve may not be flush to the housing and friction or binding may prevent the diverter valve from properly seating against the housing. As a result, the diverter valve may fail to rotate to the desired position and may fail to form a fluid seal with the housing, resulting in the flow of wash fluid not being supplied to the desired outlet ports and wash fluid leaking within diverter housing.

Accordingly, a dishwashing appliance with an improved hydraulically actuated diverter would be useful. More specifically, a hydraulically actuated diverter with features for ensuring smooth, low friction sliding of a diverter valve would be particularly beneficial.

BRIEF DESCRIPTION OF THE INVENTION

The present invention provides a hydraulically actuated diverter for selectively controlling a flow of wash fluid in a dishwashing appliance. The hydraulically actuated diverter includes a top portion and a bottom portion that are coupled together to form a diverter chamber. A shaft of a diverter valve is slidably received within a channel defined by the bottom portion of the diverter. The shaft and the channel define an annular gap that allows the shaft to slide and rotate within the diverter chamber. The shaft defines an alignment member positioned within the annular gap to prevent the shaft from moving out of alignment with the channel, reducing the likelihood of excessive friction and binding of the diverter valve. Additional aspects and advantages of the invention will be set forth in part in the following description, may be apparent from the description, or may be learned through practice of the invention.

In one exemplary embodiment, a dishwashing appliance is provided. The dishwashing appliance includes a wash chamber for receipt of articles for washing and a pump for providing a flow of wash fluid for cleaning the articles. A diverter defines a central axis, the diverter being configured for receiving the flow of wash fluid from the pump. The diverter includes a top portion defining a plurality of outlet ports for providing the flow of wash fluid to the wash chamber and a bottom portion coupled with the top portion to form a diverter chamber. The bottom portion defines a channel extending substantially along the central axis. A shaft defines an axial direction and a radial direction, is positioned within the diverter chamber, and is slidably received within the channel of the bottom portion, the shaft and the channel defining an annular gap. A diverter disc is connected to the shaft and extends in a plane substantially perpendicular to the axial direction, the diverter disc being rotatable about the axial direction. An alignment member is positioned at least partially within the annular gap and is configured for preventing the shaft from moving out of alignment with the central axis.

In another exemplary embodiment, a hydraulically actuated diverter for selectively controlling a flow of wash fluid in a dishwashing appliance is provided. The hydraulically actuated diverter defines a central axis and includes a top portion defining a plurality of outlet ports for providing the flow of wash fluid to the wash chamber and a bottom portion coupled with the top portion to form a diverter chamber, the bottom portion defining a channel extending substantially along the central axis. A shaft defines an axial direction and a radial direction, is positioned within the diverter chamber, and is slidably received within the channel of the bottom portion such that an annular gap is defined between the shaft and the channel. The shaft defines an alignment member positioned within the annular gap to prevent the shaft from moving out of alignment with the central axis. A diverter disc defines an aperture, the diverter disc being connected to the shaft and extending in a plane substantially perpendicular to the axial direction, the diverter disc being rotatable about the axial direction to selectively align the aperture with one or more of the plurality of outlet ports.

These and other features, aspects, and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION OF THE INVENTION

Figure 1:
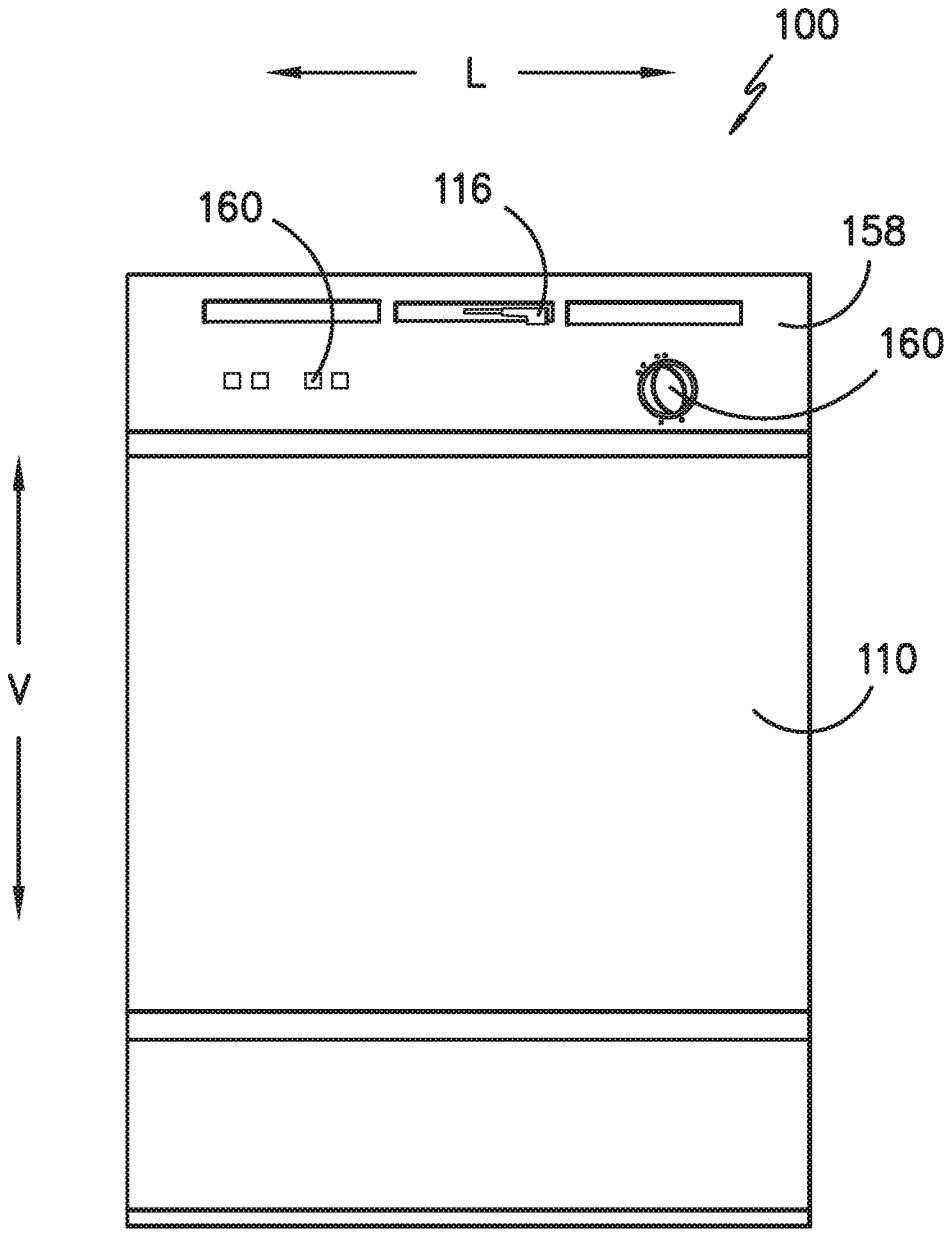
FIG. 1 provides a front view of an exemplary embodiment of a dishwashing appliance of the present invention.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "article" may refer to, but need not be limited to, dishes, pots, pans, silverware, and other cooking utensils and items that can be cleaned in a dishwashing appliance. The term "wash cycle" is intended to refer to one or more periods of time during the cleaning process where a dishwashing appliance operates while containing articles to be washed and uses a detergent and water, preferably with agitation, to e.g., remove soil particles including food and other undesirable elements from the articles. The term "rinse cycle" is intended to refer to one or more periods of time during the cleaning process in which the dishwashing appliance operates to remove residual soil, detergents, and other undesirable elements that were retained by the articles after completion of the wash cycle. The term "drying cycle" is intended to refer to one or more periods of time in which the dishwashing appliance is operated to dry the articles by removing fluids from the wash chamber. The term "fluid" refers to a liquid used for washing and/or rinsing the articles and is typically made up of water that may include additives such as e.g., detergent or other treatments. The use of the terms "top" and "bottom," or "upper" and "lower" herein are used for reference only as example embodiments disclosed herein are not limited to the vertical orientation shown nor to any particular configuration shown; other constructions and orientations may also be used.

Figure 2:
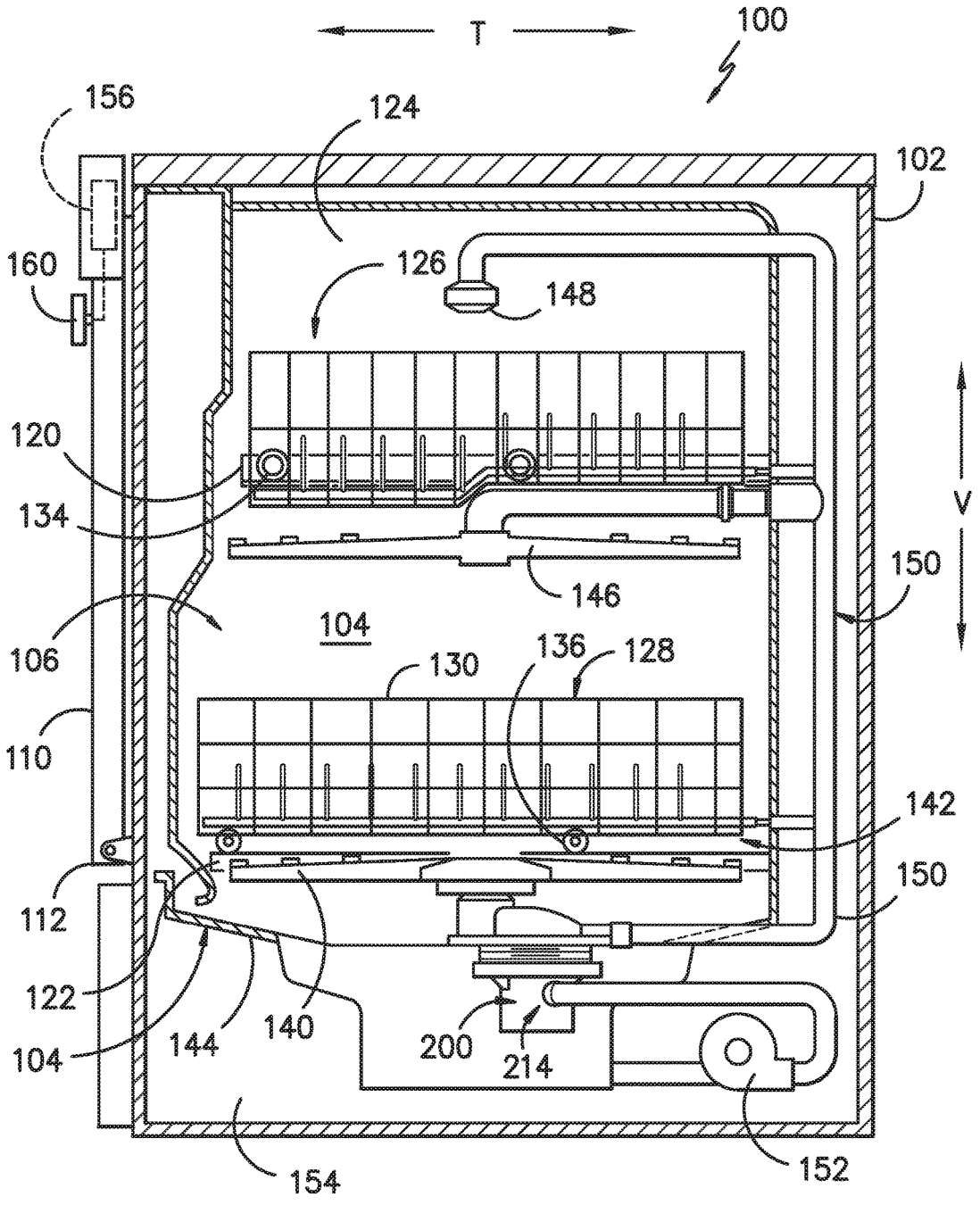
FIG. 2 provides a side, cross-sectional view of the exemplary dishwashing appliance of FIG. 1.

FIGS. 1 and 2 depict an exemplary domestic dishwasher 100 that may be configured in accordance with aspects of the present disclosure. For the particular embodiment of FIGS. 1 and 2, the dishwasher 100 includes a cabinet 102 having a tub or inner liner 104 therein that defines a wash chamber 106. The tub 104 includes a front opening (not shown) and a door 110 hinged at its bottom 112 for movement between a normally closed vertical position (shown in FIGS. 1 and 2), wherein the wash chamber 106 is sealed shut for washing operation, and a horizontal open position for loading and unloading of articles from the dishwasher 100. Latch 116 is used to lock and unlock door 110 for access to chamber 106.

Upper and lower guide rails 120, 122 are mounted on tub side walls 124 and accommodate roller-equipped rack assemblies 126 and 128. Each of the rack assemblies 126, 128 is fabricated into lattice structures including a plurality of elongated members 130 (for clarity of illustration, not all elongated members making up assemblies 126 and 128 are shown in FIG. 2). Each rack 126, 128 is adapted for movement between an extended loading position (not shown) in which the rack is substantially positioned outside the wash chamber 106, and a retracted position (shown in FIGS. 1 and 2) in which the rack is located inside the wash chamber 106. This is facilitated by rollers 134 and 136, for example, mounted onto racks 126 and 128, respectively. A silverware basket (not shown) may be removably attached to rack assembly 128 for placement of silverware, utensils, and the like, that are otherwise too small to be accommodated by the racks 126, 128.

The dishwasher 100 further includes a lower spray-arm assembly 140 that is rotatably mounted within a lower region 142 of the wash chamber 106 and above a tub sump portion 144 so as to rotate in relatively close proximity to rack assembly 128. A mid-level spray-arm assembly 146 is located in an upper region of the wash chamber 106 and may be located in close proximity to upper rack 126. Additionally, an upper spray assembly 148 may be located above the upper rack 126.

The lower and mid-level spray-arm assemblies 142, 146 and the upper spray assembly 148 are part of a fluid circulation assembly 150 for circulating water and dishwasher fluid in the tub 104. The fluid circulation assembly 150 also includes a pump 152 positioned in a machinery compartment 154 located below the tub sump portion 144 (i.e., bottom wall) of the tub 104, as generally recognized in the art. Pump 152 receives wash fluid from sump 144 and provides a flow of wash fluid to a diverter 200 as more fully described below.

Each spray-arm assembly 140, 146 includes an arrangement of discharge ports or orifices for directing washing liquid received from diverter 200 onto dishes or other articles located in rack assemblies 126 and 128. The arrangement of the discharge ports in spray-arm assemblies 140, 146 provides a rotational force by virtue of washing fluid flowing through the discharge ports. The resultant rotation of the spray-arm assemblies 140, 146 and the operation of spray assembly 148 using fluid from diverter 200 provides coverage of dishes and other dishwasher contents with a washing spray. Other configurations of spray assemblies may be used as well.

The dishwasher 100 is further equipped with a controller 156 to regulate operation of the dishwasher 100. The controller 156 may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 156 may be positioned in a variety of locations throughout dishwasher 100. In the illustrated embodiment, the controller 156 may be located within a control panel area 158 of door 110 as shown in FIGS. 1 and 2. In such an embodiment, input/output ("I/O") signals may be routed between the control system and various operational components of dishwasher 100 along wiring harnesses that may be routed through the bottom 112 of door 110. Typically, the controller 156 includes a user interface panel/controls 160 through which a user may select various operational features and modes and monitor progress of the dishwasher 100. In one embodiment, the user interface 160 may represent a general purpose I/O ("GPIO") device or functional block. In one embodiment, the user interface 160 may include input components, such as one or more of a variety of electrical, mechanical or electro-mechanical input devices including rotary dials, push buttons, and touch pads. The user interface 160 may include a display component, such as a digital or analog display device designed to provide operational feedback to a user. The user interface 160 may be in communication with the controller 156 via one or more signal lines or shared communication busses.

It should be appreciated that the invention is not limited to any particular style, model, or configuration of dishwasher 100. The exemplary embodiment depicted in FIGS. 1 and 2 is for illustrative purposes only. For example, different locations may be provided for user interface 160, different configurations may be provided for racks 126, 128, and other differences may be applied as well.

Figure 3:
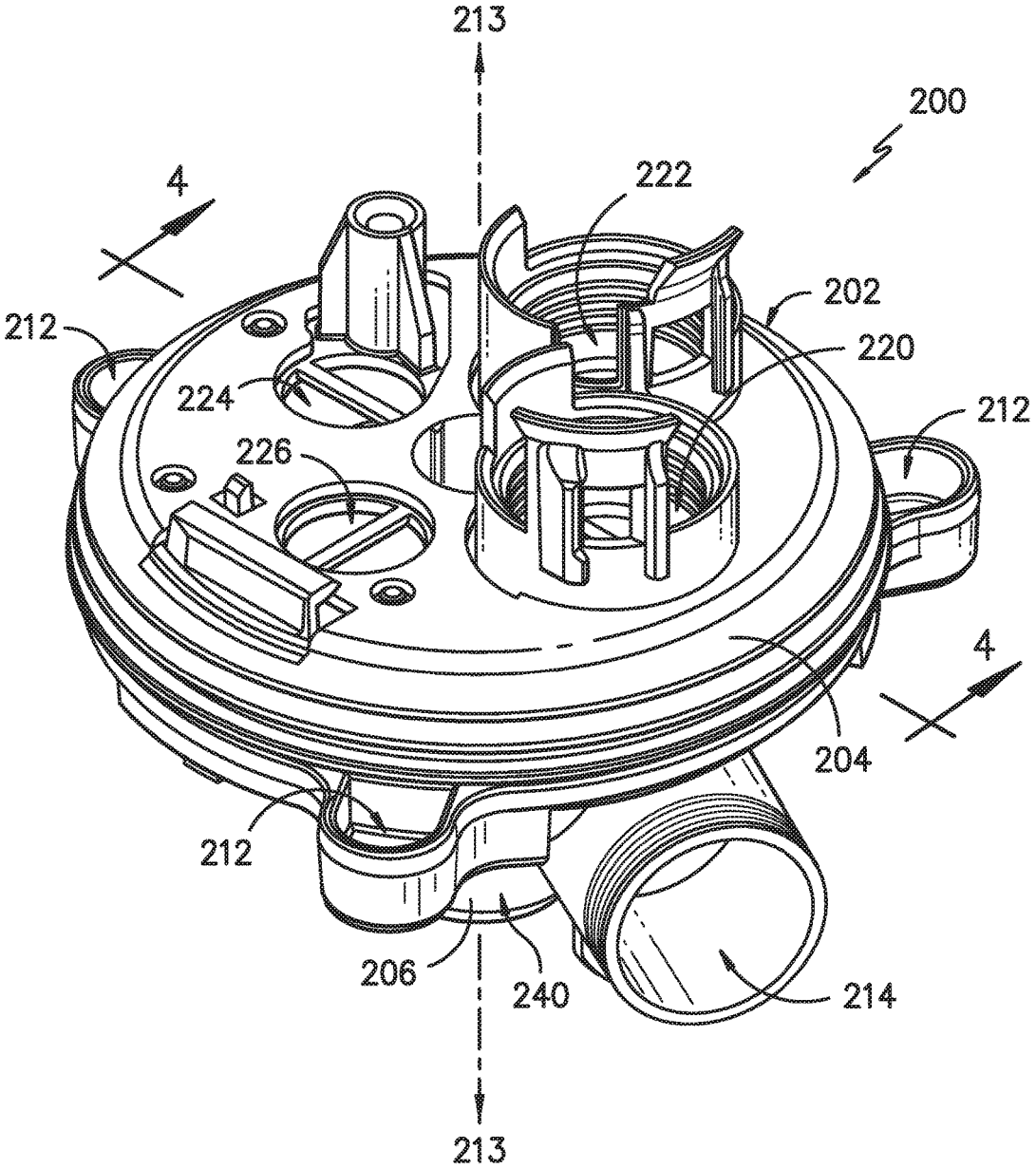
FIG. 3 is a perspective view of a diverter according to an exemplary embodiment of the present subject matter.
Figure 4:
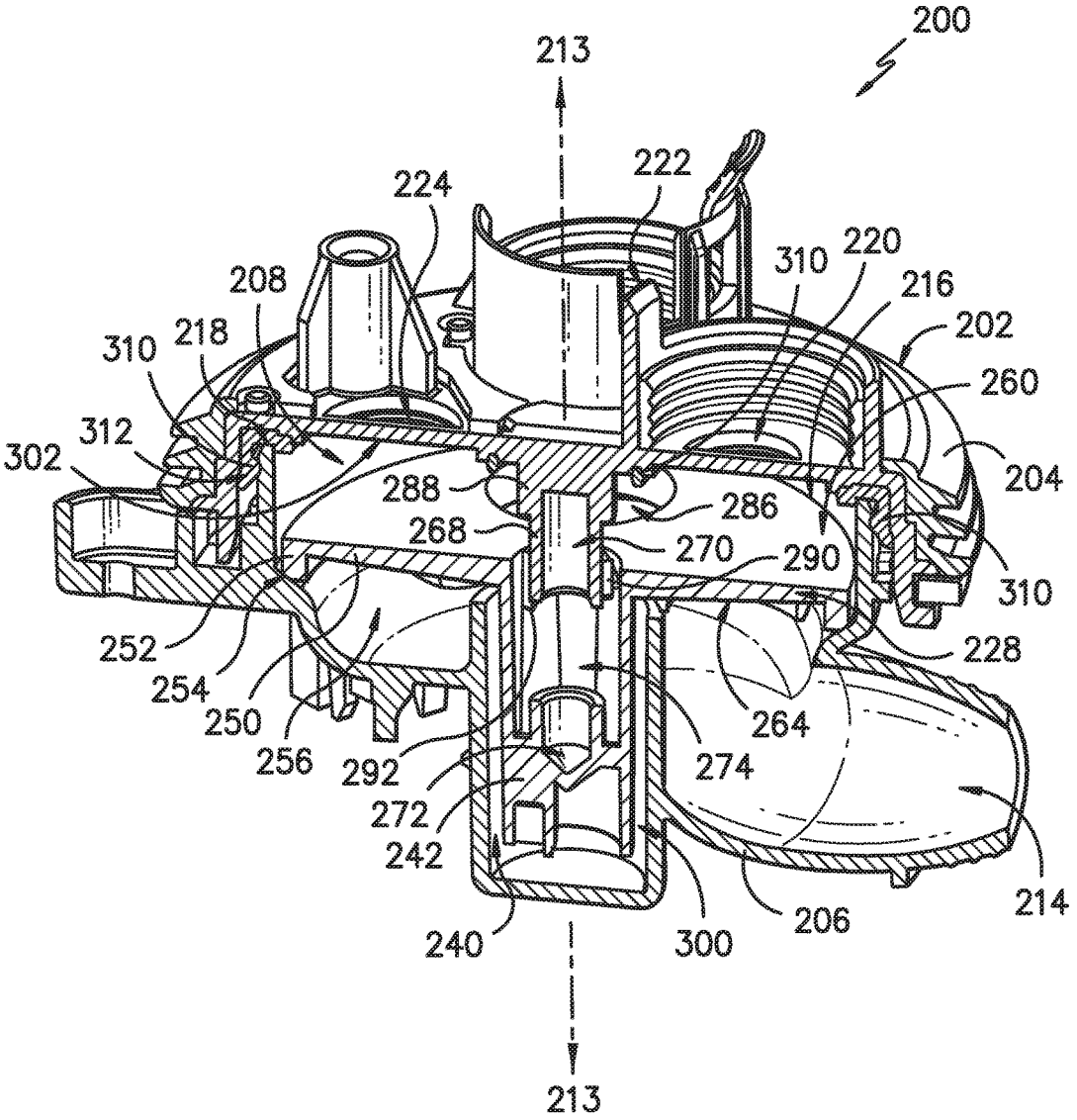
FIG. 4 is a cross sectional view of the exemplary diverter of FIG. 3, taken along Line 4-4 of FIG. 3.

FIG. 3 provides a top, perspective view of a passive, hydraulically actuated diverter 200 according to an exemplary embodiment of the present subject matter. FIG. 4 provides a side view of the exemplary diverter 200, taken along Line 4-4 of FIG. 3. As described above, pump 152 receives wash fluid from e.g., sump 144 and provides a flow of wash fluid to diverter 200. As described in detail below, diverter 200 is configured for receiving the flow of wash fluid from pump 152 and selectively supplying the flow of wash fluid to spray assemblies 140, 146, and/or 148 as well as other fluid-using components during cleaning operations.

Referring now to FIGS. 3 through 8, diverter 200 is constructed from a housing 202 that includes a first portion, e.g., top portion 204, and a second portion, e.g., bottom portion 206. As illustrated, top portion 204 is coupled to bottom portion 206 to define a diverter chamber 208. According to an exemplary embodiment, a fluid seal, e.g., an O-ring 210 (see, e.g., FIG. 5) provides a fluid seal between top portion 204 and bottom portion 206. Diverter 200 includes multiple apertures 212 that allow for fastening diverter 200 to the sump 144 of wash tub 104 (FIG. 2). As illustrated, diverter housing 202 defines a central axis 213. When diverter 200 is mounted in dishwasher 100, central axis 213 may be parallel with the vertical direction V (as shown in FIG. 2). However, it should be appreciated that diverter 200 may be mounted in other orientations as well.

Figure 5:
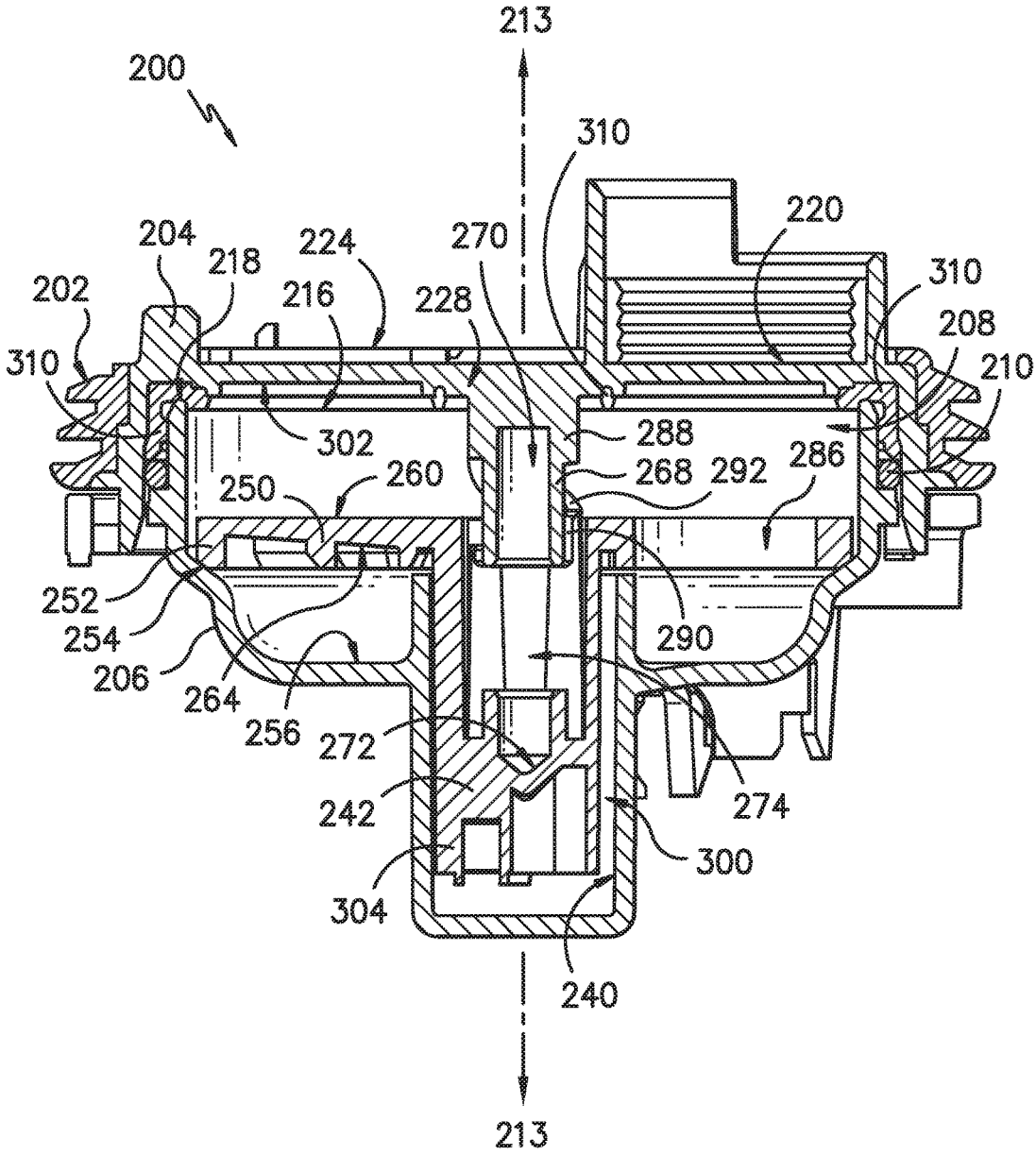
FIG. 5 is a cross-sectional view of the exemplary diverter of FIG. 3 with a diverter valve shown in a first position.
Figure 6:
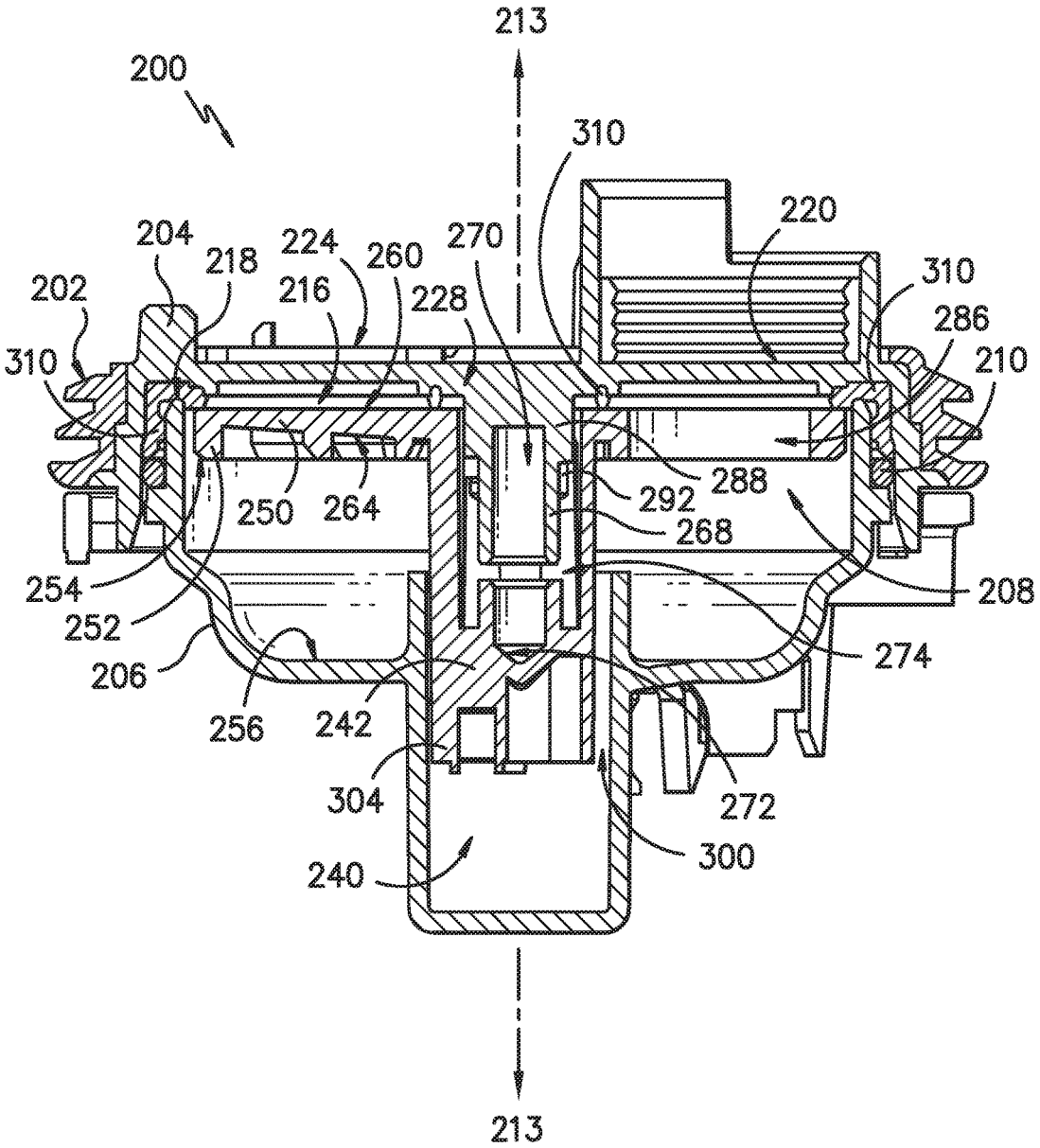
FIG. 6 is also a cross-sectional view of the exemplary diverter of FIG. 3 with the diverter valve shown in the second position.

According to the illustrated exemplary embodiment, bottom portion 206 of housing 202 defines a fluid inlet 214 that is in fluid communication with diverter chamber 208. Diverter chamber 208 also defines a fluid outlet 216, which is formed by the circular edge 218 at the top of bottom portion 206 (FIGS. 5 and 6). In this manner, the flow of wash fluid from pump 152 may flow into diverter chamber 208 through fluid inlet 214 and out of diverter chamber 208 through fluid outlet 216, e.g., to one or more of the fluid spray assemblies 140, 146, and 148.

More specifically, for this exemplary embodiment, diverter 200 includes a plurality of outlet ports through which the flow of wash fluid is provided to the spray assemblies. As shown in FIG. 3 and FIG. 4, top portion 204 of diverter 200 includes a first outlet port 220, a second outlet port 222, a third outlet port 224, and a fourth outlet port 226. However, in other embodiments of the invention, fewer than or more than four outlet ports may be used with diverter 200 depending upon e.g., the number of switchable ports desired for selectively placing pump 152 in fluid communication with different fluid-using elements of appliance 100. By way of example, first outlet port 220 can be fluidly connected with upper spray assembly 148, second outlet port 222 can be fluidly connected with mid-level spray arm assembly 146, third outlet port 224 can be fluidly connected with lower spray arm assembly 140, and fourth outlet port 226 can be fluidly connected with another fluid-using element, such as a silverware spray arm (not shown). Other connection configurations may be used as well.

Referring now specifically to FIGS. 5 and 6, diverter 200 includes a valve 228 (see also FIG. 8) that can be selectively switched between ports 220-226 without using a separate motor for such purpose. In this regard, valve 228 is positioned within diverter chamber 208 and defines an axial direction A, a radial direction R, and a circumferential direction C (see, e.g., FIG. 8). Valve 228 can be rotated about the axial direction A and can move along the axial direction A to selectively place pump 152 in fluid communication with outlet ports 220-226 and their respective spray assemblies, as described in an exemplary embodiment below.

More particularly, bottom portion 204 defines a channel 240 that extends substantially along the central axis 213 of housing 202. For example, channel 240 may be an open-ended channel extending upward along the central axis 213 from bottom portion 204. Valve 228 includes a shaft 242 that extends along the axial direction A and is received into channel 240. According to the illustrated embodiment, channel 240 and shaft 242 are both cylindrically-shaped. However, it should be appreciated that other shapes may be used as well. Shaft 242 is slidably received within channel 240 of the housing 202, such that valve 228 is movable back and forth along central axis 213 and rotatable about central axis 213 relative to housing 202. It should be appreciated that as used herein, terms of approximation, such as "approximately," "substantially," or "about," refer to being within a ten percent margin of error.

Valve 228 further includes a disk 250 that is connected to shaft 242 and extends in a plane substantially perpendicular to the axial direction A (i.e., along the radial direction R). According to the illustrated embodiment, disk 250 is a generally circular body. A flange 252 projects along axial direction A from disk 250 towards bottom portion 206 of housing 202. As illustrated, flange 252 extends from a radially outer circumference of disk 250. In addition, a distal end of flange 252 may define a frustoconical surface 254.

As can be seen by comparing FIGS. 5 and 6, valve 228 is movable along the axial direction A (or along central axis 213, which is substantially parallel to the axial direction A) between a first position shown in FIG. 5 and a second position shown in FIG. 6. In the first position shown in FIG. 5, valve 228 rests on bottom portion 206 of housing 202. More specifically, in the first position, frustoconical surface 254 rests in a complementary manner on an interior surface 256 of bottom portion 206 that is also frustoconical in shape. In the second position shown in FIG. 6, valve 228 is pressed against top portion 204 of housing 202. For this exemplary embodiment, a top surface 260 (FIG. 8) of valve 228 contacts and forms a fluid seal with top portion 204, as described in detail below.

Figure 7:
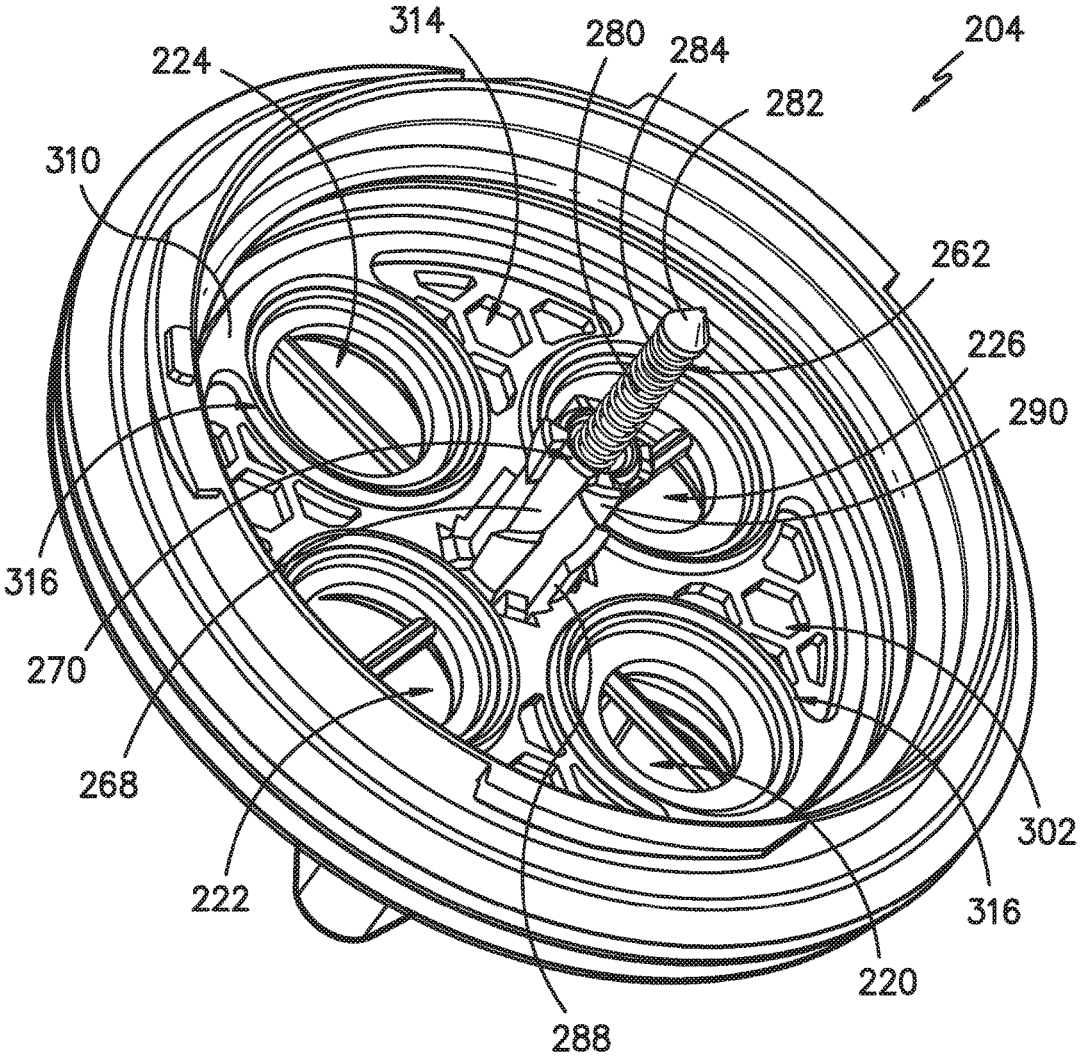
FIG. 7 is a bottom, perspective view of a first portion of the exemplary diverter of FIG. 3.

Movement of valve 228 back and forth between the first position shown in FIG. 5 and the second position shown in FIG. 6 is provided by two opposing forces: i) a flow of wash fluid passing through diverter 200 that is counteracted by ii) a biasing element 262 (see, e.g., FIG. 7). More particularly, when pump 152 is off, biasing element 262 pushes along central axis 213 against valve 228 and forces it downward along axial direction A to the first position shown in FIG. 5. Conversely, when there is a sufficient flow of wash fluid through diverter housing 200, the momentum of fluid exiting diverter chamber 208 through fluid outlet 216 will impact valve 228, and more particularly, disk 250. The momentum of the wash fluid overcomes the force provided by biasing element 262 so as to shift valve 228 along axial direction A to the second position shown in FIG. 6.

Figure 8:
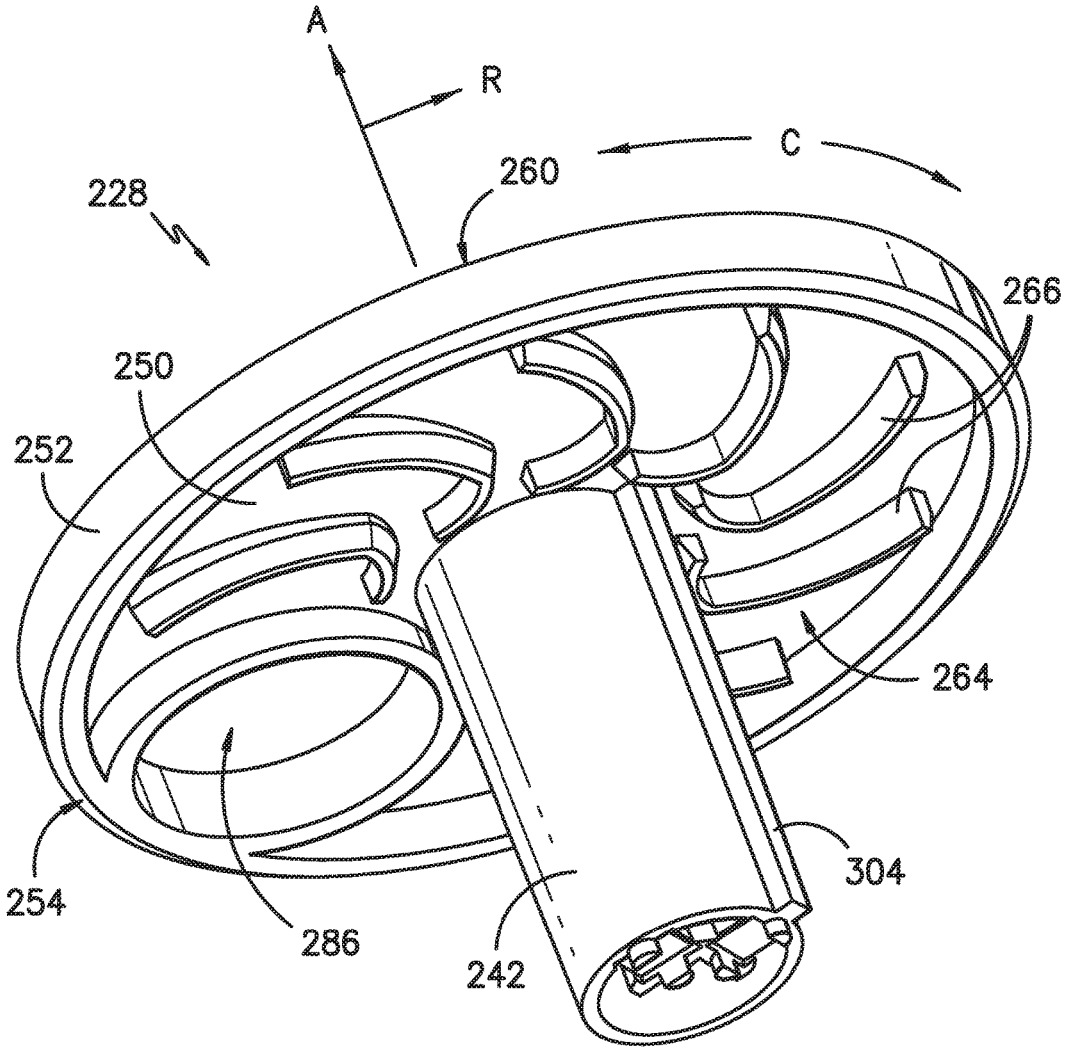
FIG. 8 is a bottom, perspective view of a diverter disc of the exemplary diverter of FIG. 3.

Flange 252 assists in capturing the momentum provided by fluid flow through fluid outlet 216. In addition, as shown in FIG. 8, a bottom surface 264 of disk 250 may further include a plurality of arcuate ribs 266. These arcuate ribs 266 capture the momentum and of the fluid flow and tend to cause the valve 228 to rotate in only one direction. The arcuate ribs 266 cause the valve 228 to rotate in a clockwise manner about the axial direction A when viewed from bottom of valve 228. As shown in FIG. 8, disk 250 may include seven arcuate ribs 266. However, one skilled in the art will appreciate that any number of arcuate ribs may be used. Similarly, the ribs may have a different size, shape, or orientation depending on the needs of the application.

As shown in the exemplary embodiment of FIGS. 5 through 7, biasing element 262 extends between a boss 268 of top portion 204 and the valve shaft 242 and is configured to urge the valve 228 toward the first position. In this regard, boss 268 may define a recess 270 into which a top end of biasing element 262 may be slidably received, and a bottom end of biasing element 262 may be received in a conically-shaped seat 272 defined, for example, at the bottom of an interior channel 274 of valve shaft 242. Conically-shaped seat 272 may be formed as an integral piece within interior channel 274, or may be constructed of separate pieces. For clarity, biasing element 262 (see FIG. 7) is not shown in FIGS. 5 and 6.

As best shown in FIG. 7, biasing element 262 may be, for example, a plunger 280 including a plunger shaft connected with a plunger head 282. The plunger head 282 may have a larger diameter than the plunger shaft and a compression spring 284 may be received onto the plunger shaft and compressed against the plunger head 282. In the exemplary embodiment, the plunger head 282 has a conically-shaped tip that is received in the conically-shaped seat 272. One skilled in the art will appreciate that the above-described biasing element 262 is only an example, and other types of biasing elements are possible. For example, in some embodiments, the biasing element may be a simple compression spring.

As best shown in FIG. 8, disk 250 defines an aperture 286 through which a flow of fluid passes during operation of diverter 200. The movement of valve 228 back and forth along the axial direction A between the first position (FIG. 5) and the second position (FIG. 6) causes valve 228 to rotate about the axial direction A so that disk 250 is rotated to selectively place aperture 286 in fluid communication with one or more of outlet ports 220-226 to provide fluid flow to respective spray assemblies.

Notably, according to the illustrated embodiment, the geometry of outlet ports 220-226 and aperture 286 provides four modes of operation when disk 250 is configured to rotate in 90 degree increments. One exemplary method and structure for achieving this rotation is described below. However, in interest of brevity, the exemplary method and structure of rotating valve 228 are only described generally. For more detail, an exemplary method of rotating a valve of a hydraulically actuated diverter is described in U.S. application Ser. No. 14/854,292 to Hofmann et al., which is incorporated herein by reference in its entirety.

Referring to FIGS. 5 and 6, boss 268 extends along central axis 213 from top portion 204 of housing 202 into interior channel 274 (FIGS. 5 and 6) defined by valve 228. Boss 268 further defines recess 270 into which a biasing element 262 (FIG. 7) is received. Boss 268 also includes a plurality of upper guide elements 288 and lower guide elements 290 that are spaced apart from each other along circumferential direction C and extend radially outward from boss 268. In addition, a plurality of cams 292 are positioned on the interior channel 274 of the cylindrical valve shaft 242 and project radially inward (i.e., along radial direction R) from the cylindrical shaft 242 into the interior channel 274.

Still referring to FIGS. 5 and 6, as a flow of fluid overcomes biasing element 262 and valve 228 moves from the first position (FIG. 5) towards the second position (FIG. 6), cams 292 engage upper guide elements 288. In this manner, valve 228 is caused to rotate 45 degrees and aperture 286 is aligned with at least one of the plurality of outlet ports 220-226. As the flow of fluid is turned off, biasing element 262 causes valve 228 to move towards the first position (FIG. 5). During this movement, cams 292 engage lower guide elements 290 and cause valve 228 to rotate another 45 degrees. Upon returning to the second position, valve 228 is again caused to rotate by 45 degrees as previously described so that aperture 286 is switched to the next outlet port. The process can be repeated to switch between outlet ports and modes of operation. In this manner, the guide elements 288, 290 and cams 292 are configured to contact each other when the valve 228 moves to an from the second position so as to cause the valve 228 to rotate incrementally through a plurality of selected angular positions to provide fluid flow through one or more outlet ports 220-226.

Although the illustrated embodiment shows a valve 228 and disk 250 having one aperture 286 and rotating in 90 degree increments, it should be appreciated that this configuration is provided only as an example. The disk 250 may have more than one aperture and may be indexed at different increments. In addition, the increments may not be constant, but may instead vary according to the needs of the application. Similarly, the housing 202 may have two, three, or more than four outlet ports, and the scheduling of fluid communication between disk 250 and the outlet ports may be manipulated as desired.

Referring still to FIGS. 5 and 6, shaft 242 is positioned within channel 240 such that an annular gap 300 is defined therebetween. During operation, wash fluid is permitted to flow into annular gap 300 and around shaft 242. In this manner, the wash fluid acts as a damper to resist motion of shaft 242 within channel 240 and reduces friction between channel 240 and shaft 242. However, valve 228 may have a tendency to move such that the axial direction A is no longer parallel to the central axis 213 of housing 202. When this occurs, top surface 260 may not be parallel to a bottom surface 302 of top portion 204 when top surface 260 first contacts top portion 204 near the second position. In addition, contact between channel 240 the misaligned shaft 242 may cause additional friction and binding that can restrict the desired movement of valve 228. As a result, friction between valve 228 and housing 202 may prevent disk 250 from forming a fluid seal with top portion 204, resulting in, e.g., fluid leaks and an insufficient supply of wash fluid to the spray assemblies.

According to the illustrated exemplary embodiment, diverter 200 may further include an alignment member 304 being positioned at least partially within annular gap 300. As explained herein, alignment member 304 is configured for preventing shaft 242 from moving out of alignment with central axis 213, i.e., for maintaining the axial direction A parallel to the central axis 213. According to the illustrated exemplary embodiment, alignment member 304 is coupled to shaft 242. More specifically, alignment member 304 protrudes from shaft 242 along the radial direction and is positioned in annular gap 300. For example, alignment member 304 may be attached to or formed integrally with shaft 242 (e.g., via injection molding). However, although the exemplary embodiment illustrates alignment member 304 as an integral part of shaft 242, it should be appreciated that any member positioned in annular gap 300 and being suitable for aligning shaft 242 within channel 240 may be used. For example, according to alternative embodiments, alignment member 304 could extend from channel 240 toward shaft 242 or could be a distinct component placed within annular gap 300 but not being coupled to either channel 240 or shaft 242.

Referring now specifically to FIG. 8, alignment member 304 is an axially-extending rib or protrusion that extends from shaft 242 along the radial direction R and extends along shaft 242 along the axial direction A. For example, according to the illustrated embodiment, alignment member 304 is a straight ridge extending along an entire length of shaft 242. However, according to alternative embodiments, alignment member might be a single, localized protrusion extending from a bottom portion of shaft 242. According to still another embodiment, multiple localized protrusions or axially extending ridges may be positioned on shaft 242 at various locations along the circumferential direction C or the axial direction A as needed depending on the application. Alignment member 304 may generally be any structure or mechanism that is configured to contact channel 240 when shaft 242 moves out of alignment with central axis 213, e.g., to maintain the spacing of annular gap 300 and axial alignment of shaft 242.

According to the illustrated embodiment, disk 250 defines a single aperture 286. Notably, as the flow of wash fluid enters diverter chamber 208, the pressure at a location radially opposite aperture 286 tends to be higher than the pressure near aperture 286. As a result, valve 228 tends to pivot within diverter chamber 208, i.e., such that the axial direction A of shaft 242 falls out of alignment with the central axis 213. More specifically, shaft 242 has a tendency to approach and contact channel at a side opposite of aperture 286 along the radial direction R. Therefore, according to an exemplary embodiment, alignment member 304 is positioned on shaft 242 opposite aperture 286 along the radial direction R. In this manner, shaft 242 is kept in proper alignment regardless of the pressure differential experienced by bottom surface 264 of disk 250.

In addition to being placed at one or multiple locations, alignment members 304 may be configured in different sizes and shapes to optimize diverter performance. For example according to the illustrated exemplary embodiment, alignment member 304 has a substantially square cross section when viewed along the axial direction A. According to another embodiment, alignment member 304 has a substantially triangular cross section when viewed along the axial direction A. Any other suitable cross sectional shape could be used. For example, shaping alignment member 304 such that it has a relatively sharp distal end may assist in scraping the walls of channel 240 and reducing the buildup of soil or grime on channel 240.

The size of alignment member 304 may also be adjusted as needed depending on the application. For example, according to the illustrated embodiment, alignment member 304 spans a radial distance about shaft 242. According to the illustrated embodiment, the radial distance less than about twenty degrees. However, the radial distance of alignment member 304 may be any other suitable distance, such as more than twenty or less than about ten degrees. In addition, the height of alignment member 304 is illustrated as extending across approximately 90% of the length of annular gap 300, but other heights of alignment member 304 may be used. Other variations in the number, size, spacing, and configuration of alignment member 304 may be used according to alternative embodiments.

Referring now to FIGS. 5 through 7, diverter may further include a strike pad 310 positioned between disk 150 and top portion 204 of diverter housing 202 along the axial direction A. Strike pad 310 is generally designed to reduce noise generated each time the flow of wash fluid forces valve 228 into the second position. More specifically, as valve 228 reaches the second position, top surface 260 of disk 250 contacts top portion 204. Oftentimes, the speed and momentum of valve 228 as it moves along the axial direction A under the force of the flow of wash fluid is quite high. As a result, the impact of disk 250 into top portion 204 can make audible noise that is detrimental to a user's perception of dishwasher 100.

Strike pad 310 is constructed of a material that is softer than top portion 204. For example, according to an exemplary embodiment, strike pad 310 is constructed of a material having a hardness between about Shore 30A and Shore 60A. According to still another embodiment, the strike pad 310 may have a hardness of about Shore 45A. One exemplary material that may be used for strike pad 310 is santoprene, but it should be appreciated that other suitably soft and resilient materials may be used according to alternative embodiments. By constructing strike pad 310 of a relatively resilient and soft material, the noise resulting from valve 228 striking top portion 204 of housing 202 may be reduced.

In addition to reducing noise from disk 250 striking top portion 204, strike pad 310 defines a relatively resilient and softer surface that enables a good fluid seal between valve 228 and top portion 204 when valve 228 is in the second position. Indeed, because strike pad 310 is softer than top portion 204 of housing 202, it may also be used as a fluid seal between top portion 204 and bottom portion 206 of housing 202. In this regard, as best illustrated in FIGS. 5 and 6, strike pad may define a lip 312 that extends over and around the circular edge of bottom portion 218 to prevent leaks from diverter chamber 208 through the junction between top portion 204 and bottom portion 206.

As illustrated in FIG. 7, strike pad 310 may be coupled to bottom surface 302 of top portion 204. In this regard, for example, strike pad 310 may be overmolded onto top portion 204. Overmolding is a process by which a previously molded part proceeds through a second molding process to add an additional feature, material, or component. Overmolding may be used to bond strike pad 310 and top portion 204 to form a single integral part. As explained above, according to the exemplary embodiment, strike pad 310 is softer than top portion 204, thus resulting in a single part having two portions with different hardnesses.

Strike pad 310 may be sized, positioned, and configured in any manner suitable for reducing noise and providing a fluid seal as described above. As illustrated in FIG. 7, strike pad 310 is localized around a perimeter of top portion 204 (e.g., to provide a seal between top portion 204 and bottom portion 206) and around each of the plurality of outlet ports 220-226. However, strike pad 310 also defines multiple voids 314 spaced along bottom surface 302 of top portion 204. These voids 314 provide space for trapped wash fluid to flow to prevent pressure buildup as the valve 228 is moving toward the second position. Including voids 314 in strike pad 310 also reduces costs and weight of diverter 200.

Strike pad 310 also defines a sealing surface 316 that extends from bottom surface 302 of top portion 204 around a circumference of each of the plurality of outlet ports 220-226. In this regard, sealing surface 316 extends along the axial direction A from bottom surface 302 toward the top surface 260 of disk 250. Sealing surface 316 may have any suitable cross sectional shape. For example, according to the illustrated embodiment, sealing surface 316 has a trapezoidal cross section, e.g., as viewed in the cross sections of FIGS. 5 and 6. However, it should be appreciated that sealing surface 316 may take any shape suitable for engaging top surface 260 and forming a fluid seal with top surface 260 when valve 228 is in the second position.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. A dishwashing appliance, comprising:

a wash chamber for receipt of articles for washing;

a pump for providing a flow of wash fluid for cleaning the articles; and a diverter defining a central axis, the diverter being configured for receiving the flow of wash fluid from the pump, the diverter comprising:

a top portion defining a plurality of outlet ports for providing the flow of wash fluid to the wash chamber;

a bottom portion coupled with the top portion to form a diverter chamber, the bottom portion defining a channel extending substantially along the central axis;

a shaft defining an axial direction and a radial direction, the shaft being positioned within the diverter chamber and being slidably and rotatably received within the channel of the bottom portion, the shaft and the channel defining an annular gap;

a diverter disc connected to the shaft and extending in a plane substantially perpendicular to the axial direction, the diverter disc being rotatable about the axial direction and defining an aperture for selectively providing fluid communication with one or more of the plurality of outlet ports; and an alignment member being positioned at least partially within the annular gap and being configured for preventing the shaft from moving out of alignment with the central axis.

2. The dishwashing appliance of claim 1, wherein the alignment member is coupled to the shaft.

3. The dishwashing appliance of claim 2, wherein the alignment member is an axially-extending rib projecting outward from the shaft along the radial direction, the alignment member being configured to contact the channel when the shaft moves out of alignment with the central axis.

4. The dishwashing appliance of claim 1, wherein the alignment member is positioned on the shaft opposite the aperture along the radial direction.

5. The dishwashing appliance of claim 1, wherein the alignment member extends an entire length of the shaft.

6. The dishwashing appliance of claim 1, wherein the channel and the shaft are cylindrically-shaped.

7. The dishwashing appliance of claim 1, wherein the alignment member spans a radial distance about the shaft, the radial distance being less than about twenty degrees.

8. The dishwashing appliance of claim 7, wherein the radial distance is less than about ten degrees.

9. The dishwashing appliance of claim 1, wherein the alignment member has a substantially square cross section when viewed along the axial direction.

10. The dishwashing appliance of claim 1, wherein the alignment member has a substantially triangular section when viewed along the axial direction.

11. The dishwashing appliance of claim 1, wherein the alignment member comprises a plurality of alignment members positioned on the shaft at different locations along a circumferential direction.

12. A hydraulically actuated diverter for selectively controlling a flow of wash fluid in a dishwashing appliance, the hydraulically actuated diverter defining a central axis, the hydraulically actuated diverter comprising:

a top portion defining a plurality of outlet ports for providing the flow of wash fluid to the wash chamber;

a bottom portion coupled with the top portion to form a diverter chamber, the bottom portion defining a channel extending substantially along the central axis;

a shaft defining an axial direction and a radial direction, the shaft being positioned within the diverter chamber and being slidably and rotatably received within the channel of the bottom portion such that an annular gap is defined between the shaft and the channel, the shaft defining an alignment member positioned within the annular gap to prevent the shaft from moving out of alignment with the central axis; and a diverter disc defining an aperture for selectively providing fluid communication with one or more of the plurality of outlet ports, the diverter disc being connected to the shaft and extending in a plane substantially perpendicular to the axial direction, the diverter disc being rotatable about the axial direction to selectively align the aperture with one or more of the plurality of outlet ports.

13. The hydraulically actuated diverter of claim 12, wherein the alignment member is an axially-extending rib projecting outward from the shaft along the radial direction, the alignment member being configured to contact the channel when the shaft moves out of alignment with the central axis.

14. The hydraulically actuated diverter of claim 12, wherein the alignment member is positioned on the shaft opposite the aperture along the radial direction.

15. The hydraulically actuated diverter of claim 12, wherein the alignment member extends an entire length of the shaft.

16. The hydraulically actuated diverter of claim 12, wherein the channel and the shaft are cylindrically-shaped.

17. The hydraulically actuated diverter of claim 12, wherein the alignment member spans a radial distance about the shaft, the radial distance being less than about twenty degrees.

18. The hydraulically actuated diverter of claim 12, wherein the alignment member has a substantially square cross section when viewed along the axial direction.

19. The hydraulically actuated diverter of claim 12, wherein the alignment member has a substantially triangular section when viewed along the axial direction.

20. The hydraulically actuated diverter of claim 12, wherein the alignment member comprises a plurality of alignment members positioned on the shaft at different locations along a circumferential direction.

* * * * *